US005114736A

United States Patent [19]

Griffiths et al.

[11] Patent Number: 5,114,736

[45] Date of Patent: May 19, 1992

[54] METHOD FOR VARYING NOZZLE TRAVERSAL SPEED TO OBTAIN UNIFORM THICKNESS ELECTROSTATICALLY SPRAY COATED LAYERS

[75] Inventors: Clifford H. Griffiths, Pittsford; Paul J. Brach, Rochester; Edward C. Williams, Palmyra; Ronald A. Gaither; Timothy J. Leenhouts, both of Fairport, all of N.Y.

[73] Assignee: Xerox Corporation, Stamford, Conn.

[21] Appl. No.: 458,184

[22] Filed: Dec. 27, 1989

[51] Int. Cl.[5] ..... B05D 1/04

[52] U.S. Cl. ..... 427/30; 427/33; 427/425; 427/427

[58] Field of Search ..... 427/27, 30, 33, 425, 427/427

[56] References Cited

U.S. PATENT DOCUMENTS

| | | | |
|---|---|---|---|
| 2,794,416 | 6/1957 | Shepherd | 118/51 |
| 4,375,505 | 3/1983 | Newkirk | 430/99 |
| 4,442,135 | 4/1984 | Snaddon | 427/31 |
| 4,747,992 | 5/1988 | Sypula et al. | 264/130 |
| 4,779,564 | 10/1988 | Kiefer et al. | 118/628 |
| 4,811,689 | 3/1989 | Yamamoto et al. | 118/624 |

FOREIGN PATENT DOCUMENTS 619454 1/1976 U.S.S.R. .

*Primary Examiner*—Bernard Pianalto
*Attorney, Agent, or Firm*—Oliff & Berridge

[57] ABSTRACT

A method and apparatus for electrostatically spray coating substrates with layers of material having uniform thicknesses is provided. A substrate to be coated is electrically grounded and an electrically charged, atomized spray of coating material is directed toward the substrate from a nozzle. The nozzle is traversed along a length of the substrate, which can also be rotated, to coat substantially the entire surface of the substrate. In order to compensate for thickness variations in the applied coating, the speed of traversal of the nozzle is varied. In a preferred embodiment, where photoreceptor drums are produced by spraying a photoreceptor material onto a cylindrical substrate, the speed of traversal of the nozzle is reduced as it approaches at least one end of the cylindrical substrate.

6 Claims, 3 Drawing Sheets

METHOD FOR VARYING NOZZLE TRAVERSAL SPEED TO OBTAIN UNIFORM THICKNESS ELECTROSTATICALLY SPRAY COATED LAYERS

BACKGROUND OF THE INVENTION

1. Field of the Invention

The present invention involves apparatus and methods for electrostatically spray coating substrates, particularly cylindrical substrates, to provide layers having uniform thickness along their entire lengths.

Electrophotographic imaging systems include a photo-receptor material which is electrically charged, exposed to light and then toner developed to form an image on the photoreceptor. This image is then transferred, either directly or indirectly onto a recording medium, i.e., paper, and fixed thereto. The photoreceptor material can be provided on a cylindrical substrate (a drum), in the form of a belt or in the form of a continuous web. Even when provided in the form of a belt, it is common to form photoreceptor layers on these belts by either forming a belt or placing a preformed belt on a cylindrical substrate and then coating the belt with the photoreceptor material. The coated belt is then removed from the substrate. See, for example, U.S. Pat. No. 4,747,992 to Sypula et al, the disclosure of which is herein incorporated by reference.

A spray coating process can be used for applying the photoreceptor material to a substrate (this applies whether a coated drum or a belt is ultimately formed). This spray coating process involves traversing a spray gun parallel to the longitudinal axis of a rotating cylindrical substrate and directing an atomized stream of photoreceptor material onto the substrate. Since the substrate is rotated while spraying takes place, the entire surface of the cylindrical substrate is coated. With proper controls the process can coat layer thicknesses from less than 100 Angstrom to more than 100 microns with better than ±5% reproducibility.

A major drawback of the above-described simple spray process is the relatively low efficiency with which material is applied. For some photoreceptor materials, only about 10% of the sprayed material coats the substrate. The excess sprayed material is carried past the drum and is captured by filters at the spray booth air exit. This low efficiency results in greatly increased coating solvent emissions which can necessitate the installation of solvent recovery equipment, further raising costs.

An established technique for the improvement of material efficiency is the application of an electrostatic charge to the sprayed fluid droplets. When the substrate is grounded, a positive attraction is created between the droplets and the substrate which causes the materials efficiency to increase to greater than 75%. Unfortunately, the use of electrostatic charge has a disadvantage in that cylindrical substrates coated by this method have coating thicknesses which vary along the length of the cylinder. Generally, thickness decreases toward the ends of the substrate. This thickness variation results from at least two sources: variations in the electrostatic forces between the substrate and droplets due to electrostatic "end effects" at the ends of the cylindrical substrate and attraction between the droplets and other nearby grounded surfaces such as the substrate support ("ground effects"). Since the cylindrical substrates are frequently supported on vertical supports which extend from a chain conveyor, these ground effects can be substantial.

Non-uniformity of the thickness of the photoreceptor material poses a substantial limitation to the use of electrostatic spraying processes for forming photoreceptor drums or belts. In order to produce uniform images, the photoreceptor material thickness must be uniform. Uniformity can be achieved by reducing the spray coating efficiency along thicker areas so as to produce a thickness equal to that of the thinnest areas. Uniformity can also be achieved by not using the end portions of the drum or belt. Neither of these alternatives is desirable since the first decreases the materials efficiency and the second alternative requires longer drums to be constructed which increases the size of the overall device. While it has been suggested that the electrostatic spray gun voltage be varied to compensate for thickness variation, the increase in charge on the droplets not only increases the attractive forces between the droplets and substrate, but also increase the attractive forces between the droplets and the other nearby grounded surfaces.

OBJECTS AND SUMMARY OF THE INVENTION

It is an object of the present invention to provide an apparatus and method for electrostatically spray coating substrates with at least one layer of material having a uniform thickness.

It is another object of the present invention to provide an apparatus and method for electrostatically spray coating substrates which minimizes the passage of excess spray material past the substrate.

It is a further object of the present invention to provide an apparatus and method for electrostatically spray coating a substrate which reduces coating solvent emissions.

The present invention makes use of the traversal speed of an electrostatic atomizing nozzle to offset variations in thickness an applied coating of material which would otherwise be caused by external effects. Specifically, the present invention provides an apparatus and method for varying the speed of traversal of a nozzle as it approaches the ends of a cylindrical substrate which is being electrostatically spray coated by the nozzle. By programming the spray gun traversal rate to correct for thickness errors through an open loop correction algorithm, the thickness uniformity can be maximized.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENT

The present invention is applicable to any process which involves electrostatic spray coating of a substrate. The particular embodiment shown and described involves an application of the present invention to a process for producing photoreceptor drums for use in electrostatic imaging machines. Although the illustrated embodiment is arranged for spray coating drums which are oriented with their longitudinal axes extending vertically, the present invention is applicable regardless of the orientation of the sprayed substrate.

Figure 1:
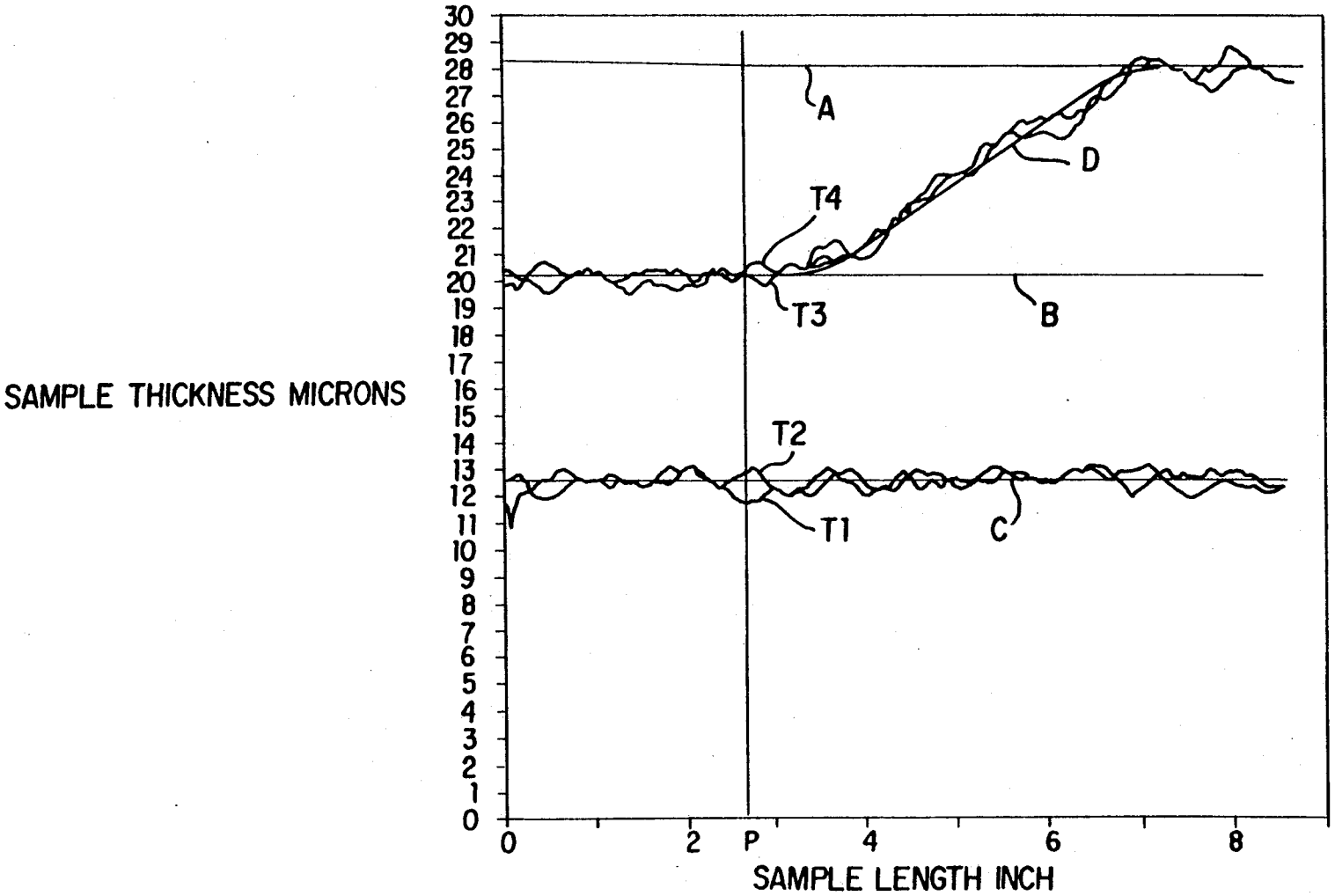
FIG. 1 is a plot of the thickness of an electrostatically spray coated transport layer down the length of a cylindrical substrate as a function of traversal speed.

FIG. 1 shows a plot of the measured thickness of an electrostatically spray coated layer down the length of a cylindrical substrate as a function of the speed of traversal of a spray gun along the substrate. Plots A, B and C correspond to traversal speeds of 7.5 ft/min, 10.7 ft/min and 17 ft/min, respectively. As can be seen from FIG. 1, the thickness is directly proportional to the inverse of the speed of traversal. Plot D corresponds to the thickness of a layer that is applied along a part of a cylindrical substrate as a traversal speed of 10.7 ft/min changes to a traversal speed of 7.5 ft/min. The speed of traversal is changed at point P. The thickness of the layer does not immediately jump to the equilibrium thickness associated with the new traversal speed, but as can be seen from FIG. 1, a period of time (and associated traversal distance) will be required before the new equilibrium thickness is reached. The time to reach the new equilibrium thickness is a function of the time to complete the change of scan speed and the width of the spray pattern in the direction of the cylinder axis. The thickness traces T1, T2, T3 and T4 for each gun speed traversal program are measured thicknesses of separate samples cut from a coated cylinder.

With other process conditions constant, the thickness of the spray coated layer on a cylinder substrate is inversely proportional to the speed of traversal of the cylinder along its longitudinal axis by the spray gun. If material efficiency varies during the spray gun traversal due to electrostatic field effects, the resulting thickness change can therefore be compensated by changing the gun speed during its traversal of the substrate. The gun speed should be programmed to assure that the quantity of spray material reaching the cylindrical substrate per unit area per unit time does not change. If such a program is used, coating thickness is constant over the entire surface of the photoreceptor and maximum material efficiency is achieved. Since the deposition rate is inversely proportional to the gun scan rate, the required scan rate program can be calculated from the thickness variation observed with a single traversal speed.

Figure 3:
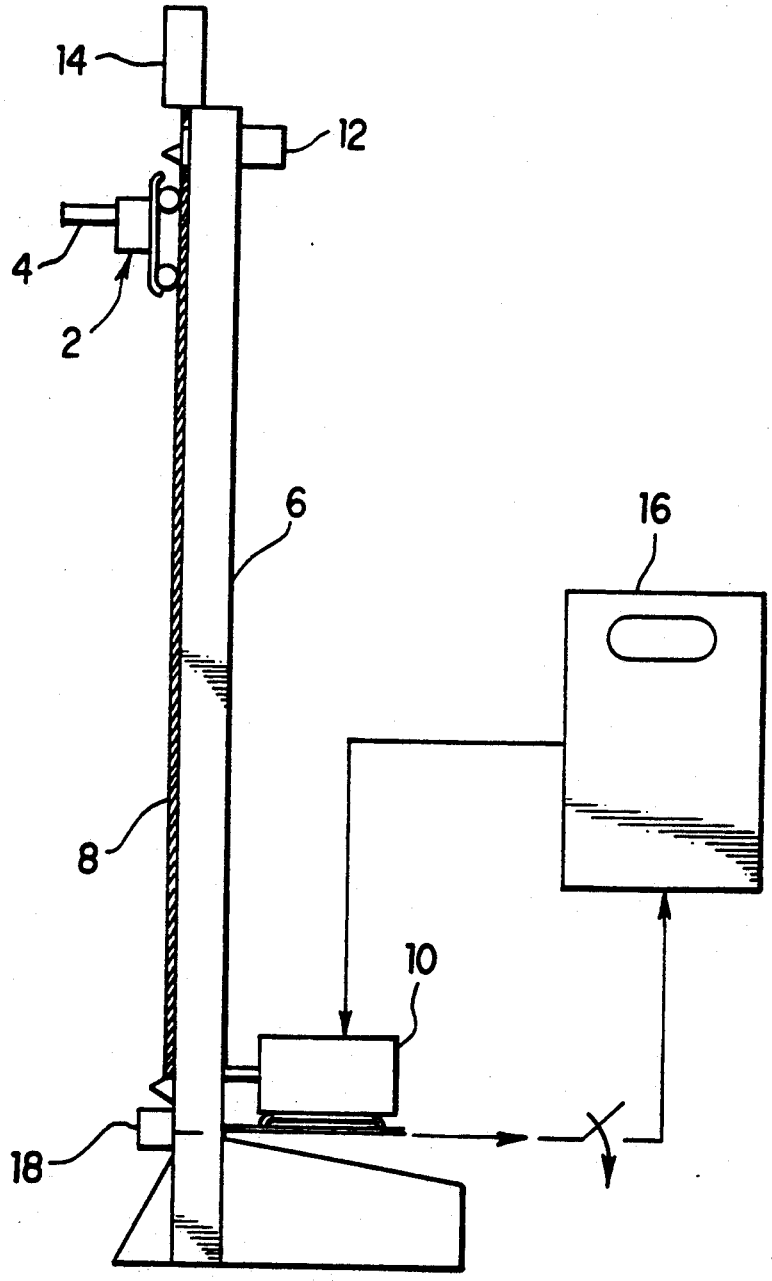
FIG. 3 shows a side view of one embodiment of a reciprocator device of the present invention.

FIG. 3 shows one possible set-up for electrostatically spray coating a photoreceptor material onto a drum (not shown) which is oriented with its longitudinal axis extending vertically. It is common practice to use an assembly line for producing photoreceptor coated drums. In such an assembly line, a series of vertically oriented drums are arranged on a conveyor which sequentially directs each drum to a desired number of spray stations for applying one or more layers of materials onto each drum. The materials used for coating photoreceptor drums can be, for example, those disclosed in U.S. Pat. No. 4,747,992. The spray coating device includes an electrostatic spray gun 2 which includes a nozzle 4. This gun is supplied with material from a reservoir (not shown). The gun 2 is mounted on a threaded spindle 8 which is supported by frame 6. The gun 2 is moved in the vertical direction by gun position motor 10. The shaft of motor 10 is coupled with spindle 8 so as to cause rotation thereof which moves the gun 2 vertically along the spindle 8. Although not shown, an additional motor can be provided to control the movement of gun 2 in the horizontal direction.

The movement of gun 2 can be monitored and controlled using a computer 16. Computer 16 receives data from a number of monitoring devices such as encoder/-counter 14 which monitors the vertical position of gun 2 and home switches 12, 18 which indicate when gun 2 has reached the ends of its traversal. The monitored data is compared with preset parameters by the computer which then appropriately controls motor 10. Computer 16 controls all aspects of mechanical movement such as, for example, start-stop points, speed, acceleration, deceleration and number of cycles utilized. The distance of movement and timing sequence are broken up into any assigned number of segments, each of which is given, for example, a speed, acceleration or deceleration, and switching as to gun on/off, pause and dwell. The number of segments chosen determines the length of each segment by dividing the whole stroke distance, which can also be varied, by the number of segments. All functions are determined from pulse encoder 14 which starts at the "home" position, each pulse outputted by encoder 14 representing 10 microns of traverse movement. The only fixed variable is the home position which is read by microswitches 12 and 18. The "home" position assignment is given each cycle (i.e., each time one of the microswitches 12, 18 is actuated). The time required for a complete cycle may be varied by changing the speed of the reciprocator, any of the dwell or stop points, total stroke distance or number of strokes per cycle. When the total cycle of the unit has been run, the microprocessor signals an indexing mechanism to advance the next set of objects to be sprayed and the complete sequence repeats.

Figure 2B:
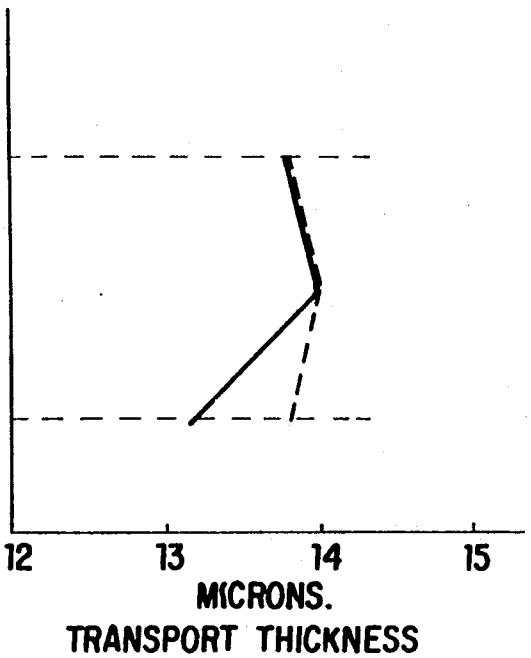
FIG. 2 shows gun speed programs and resulting thickness profiles for an electrostatically spray coated cylindrical drum supported at its bottom end.
Figure 2A:
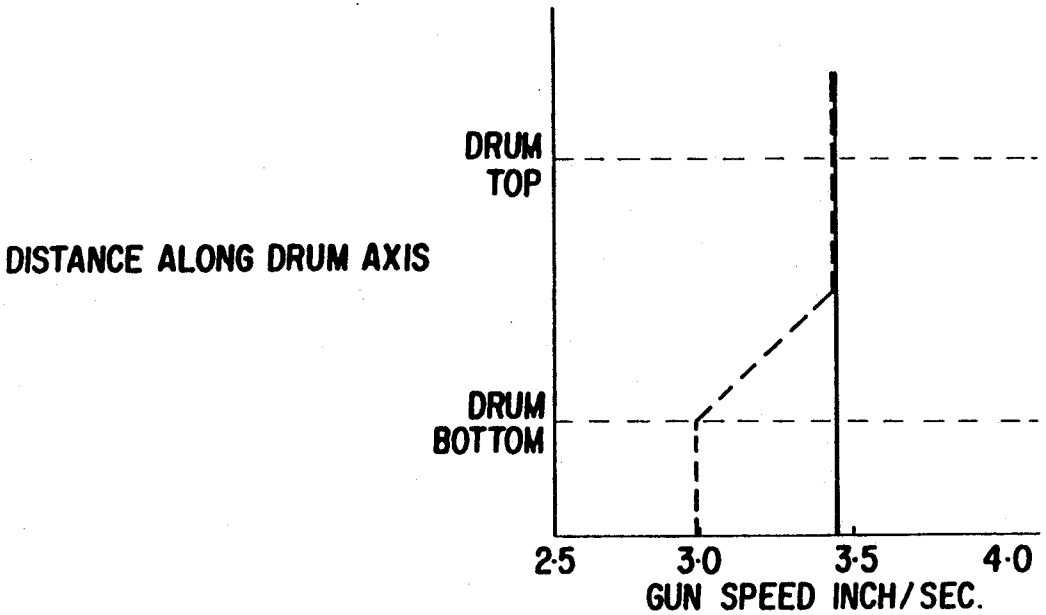

FIG. 2 shows gun speed programs and resulting thickness profiles for electrostatic spray coating a photoreceptor transport layer on a drum. The continuous line shows the constant speed profile and resulting 0.8 micron thickness change from the center to the bottom of the drum. This thickness change is caused by the previously described "end effects" and "ground effects". The dashed line shows that programming a ramped reduction in traversal speed from the center of the drum to the bottom results in the reduction of thickness difference to 0.2 microns which is within the measurement error.

Although a specific example is disclosed, the present invention is applicable to any electrostatic spray coating process which is subject to thickness nonuniformities due to field variations and adjacent parasitic grounded surfaces. Accordingly, the preferred embodiments of the invention as set forth herein are intended to be illustrative, not limiting. Various changes may be made without departing from the spirit and scope of the invention as defined in the following claims.

What is claimed is:

1. A method for coating an electrically grounded elongated cylindrical substrate with a material, said cylindrical substrate being supported at one end by an electrically grounded support, comprising:

atomizing in at least one spray nozzle a liquid coating material to form fluid droplets;

applying an electrical charge of one polarity to said droplets;

directing said droplets toward said electrically grounded elongated cylindrical substrate to form a coating of said coating material on said substrate;

traversing said nozzle along a length of said cylindrical substrate from said one end to another end of said cylindrical substrate; and varying a speed of traversal of the nozzle as said nozzle traverses the length of said cylindrical substrate by reducing the speed of traversal of the nozzle as said nozzle approaches both of said ends of said cylindrical substrate so as to compensate for variations in electrostatic forces between said cylindrical substrate and said droplets to maintain the thickness of said coating substantially uniform to within 0.2 micron along the length of said cylindrical substrate.

2. The method according to claim 1, wherein the speed of traversal of said nozzle is reduced by a greater amount at one end of said substrate than at said other end.

3. The method according to claim 1, wherein said substrate is rotated about a longitudinal axis thereof during coating.

4. The method according to claim 1, wherein a longitudinal axis of said substrate is vertically arranged during coating.

5. The method according to claim 1, wherein a longitudinal axis of said substrate is horizontally arranged during coating.

6. The method according to claim 1, wherein said material is a photoreceptor material.

* * * * *